US005351818A

United States Patent [19]

Daneshvar

[11] Patent Number: 5,351,818

[45] Date of Patent: Oct. 4, 1994

[54] MEDICINE BOX

[76] Inventor: Yousef Daneshvar, 33200 Slocum, Farmington, Mich. 48024

[21] Appl. No.: 932,562

[22] Filed: Aug. 20, 1992

[51] Int. Cl.[5] ..... B65D 77/00

[52] U.S. Cl. ..... 206/216; 206/232; 206/534; 206/538; 220/522

[58] Field of Search ..... 206/216, 232, 459.5, 206/472, 534, 534.1, 538, 539, 581, 561, 521, 522, 523, 528

[56] References Cited

U.S. PATENT DOCUMENTS

| | | | |
|---|---|---|---|
| 417,979 | 12/1889 | Borcherdt | 220/522 |
| 1,610,146 | 12/1926 | Panzer | 220/523 |
| 1,644,830 | 10/1927 | Henderson | 220/552 |
| 2,008,429 | 7/1935 | Weatherhead, Jr. | 220/521 |
| 2,145,106 | 1/1939 | Anderson | 206/561 |
| 3,225,913 | 12/1965 | Lee | 206/232 |
| 3,627,122 | 12/1971 | Garbe, Jr. | 206/232 |
| 3,675,620 | 7/1972 | Baustin | 206/538 |
| 3,777,418 | 12/1973 | Cooper | 206/232 |
| 3,833,098 | 9/1974 | Alderman | 190/1 |
| 4,318,477 | 3/1982 | Kerpe | 206/534 |
| 4,418,823 | 12/1983 | Romick | 206/459.5 |
| 4,470,488 | 9/1984 | Broussard | 220/522 |
| 4,473,156 | 9/1984 | Martin | 206/534 |
| 4,693,371 | 9/1987 | Malpass | 206/534 |
| 4,749,085 | 6/1988 | Denny | 206/534 |
| 4,784,264 | 11/1988 | Sykes | 206/472 |
| 5,235,822 | 8/1993 | Leonovich, Jr. | 206/542 |

*Primary Examiner*—David T. Fidel

[57] ABSTRACT

The box is rectangular and has a hinged lid for opening and closing the top. The bottom of the box has storage space for pill bottles and above this storage space, a ledge on which a weekly pill container box rests. The weekly pill container box contains a week's supply of pills in daily compartments and has a unique arrangement of doors for opening and closing the compartments. The box has a unique arrangement of compartments. It also contains a cassette recorders, windows, and an inner lid which provides a pill display, all for presenting useful information. These features can be used for presenting not only medical information, but other information as well, and the box can be used for other than medical purposes.

12 Claims, 9 Drawing Sheets

MEDICINE BOX

BACKGROUND OF THE INVENTION

This invention arises from my observation that many of my patients have had problems with remembering dosages of and directions for medications that I had prescribed for them. I have noted that some of my patients, especially older ones, have had significant difficulty in remembering new orders and directions, which are very important and critical, and that a mistake could cause major side effects for them as well as a problem for the doctor. My observations have led to a solution which is embodied in the present invention and which I truly believe is unique and very useful.

My invention is basically a box that is designed to conveniently hold medications, allowing the person to conveniently carry the medications, to easily see samples of the medications, and to listen to directions of the physician many times over. I believe this will help in preventing worry, bad feelings, and discomfort in patients, and that is what I work for.

SUMMARY OF THE INVENTION

My invention is based on a very useful basic device: a box. I provide the box with clear windows in its sides and top for insertion of photos or written materials, directions, instructions, etc., and also with either a place for a cassette recorder and player (herein sometimes referred to as record player or recorder), or a record player fixed to its wall, that allows tapes to be heard conveniently. While I believe that this device has many uses in many ways, for example in educational purposes of many kinds, one particular good use of this box is as a medical box of about lunch box size to hold medications of a patient inside it.

This box can be made from plastic or synthetic materials, such as brief case materials. In the case of a medical box, it can have a soft layer of sponge on the inside of its bottom wall to allow medication bottles to sit on it easily. The box can be divided into small spaces with the use of plastic dividing walls of about 0.5 to 2 mm thick whose ends slide into small depressions, or slots, in the walls. Many of these slots are provided in the box's walls to allow the distances between the dividing walls to be adjustable in order for the spaces between them to be easily adjusted. An inner lid of the box is a clear plastic having spaces that can hold pills, and adjacent the pill spaces, a sheet, such as my "Medical Chart", containing their directions. A space is also provided in the inner lid to allow a booklet, such as my "Medical Passport", to be inserted The box thereby allows a patient: to store his or her medications inside the box; to see samples of tablets in the clear plastic spaces and also read the name and directions of the medications easily; and to record the directions for medications in the doctor's office and later listen to the directions and advice of the medical profession or of the patient's family.

The medical box also contains a "weekly pill box" that is designed to hold medications for one week and to help the patient plan and use them much more easily and to eliminate the need for the patient to open individual medication bottles each time he or she has to take a pill. The "weekly pill box" is conveniently arranged inside the medical box. I believe that my invention is a very useful tool that will help patients as well as their families in many ways.

DESCRIPTION OF THE PREFERRED EMBODIMENT

Figure 1:
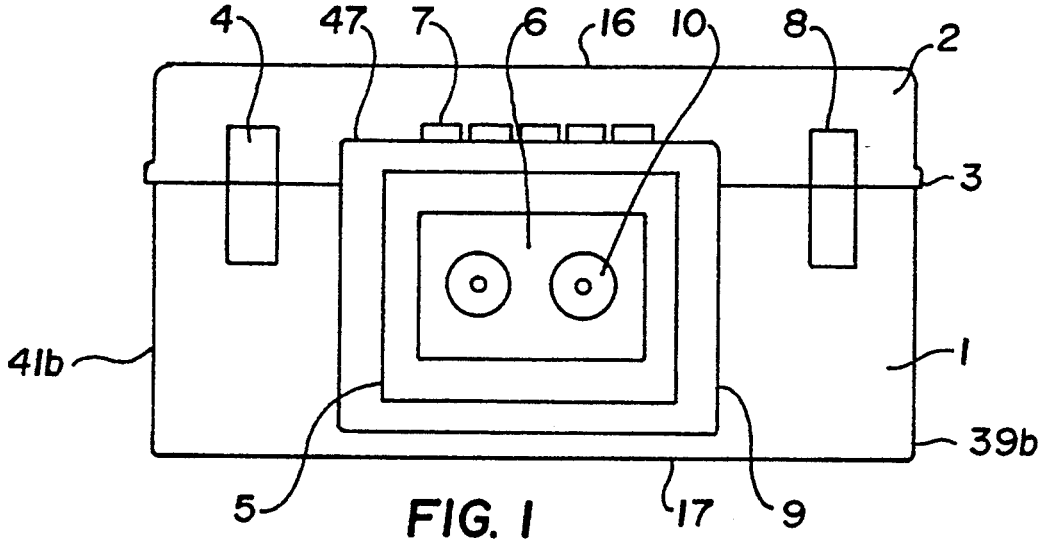
FIG. 1 is a front elevational view of a medical box according to the present invention.
Figure 2:
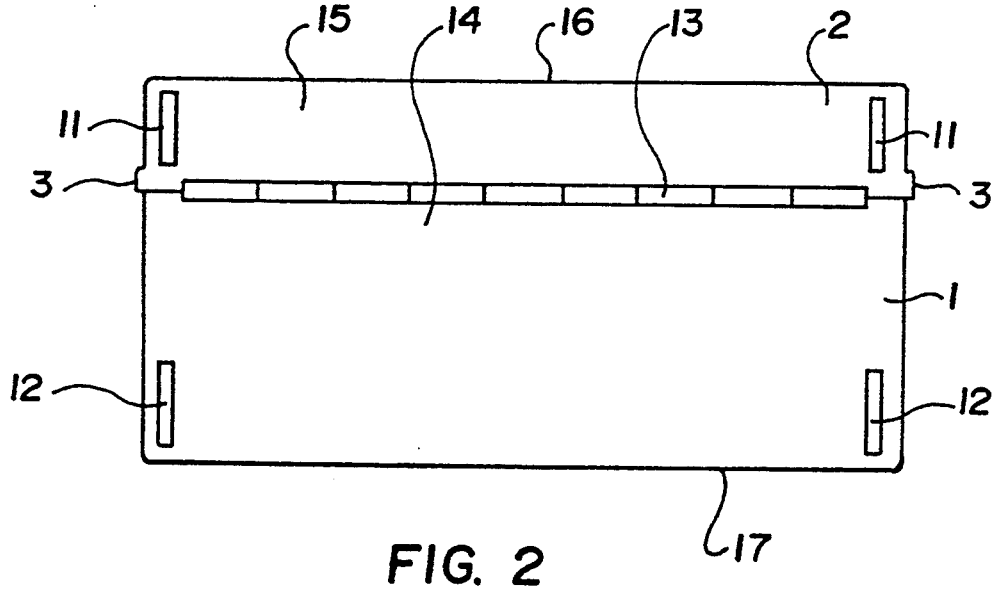
FIG. 2 is a rear elevational view of the medical box.
Figure 3:
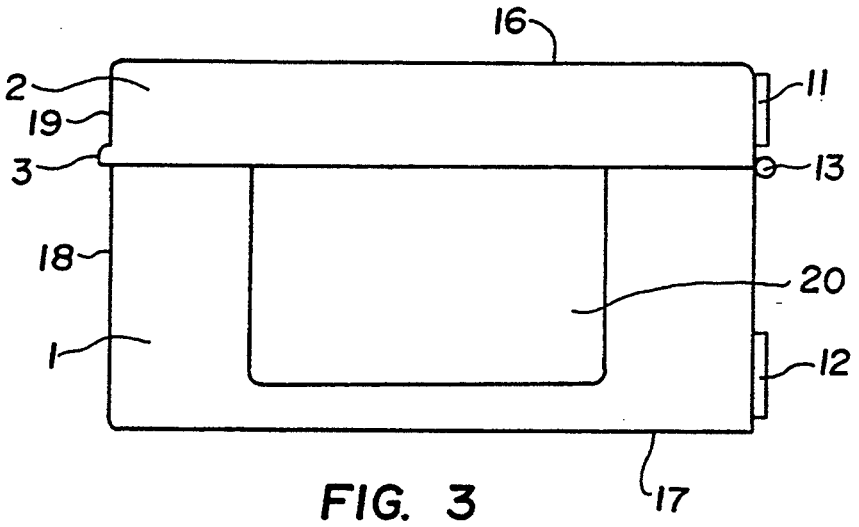
FIG. 3 is a right side elevational view of the medical box.

FIGS. 1–11 show the general organization and arrangement of the medical box. The medical box comprises a body 1 in the form of a generally rectangular container having a base, or bottom wall, 17, a front wall 18, a back wall 14, a right side wall **39*b*, and a left side wall 41*b*. It also comprises a generally rectangular shaped upper, or outer, lid 2 having a top, or upper wall 16, a front wall 19, and a back wall 15. It also has a lower edge 3 that overlaps the upper edge of body 1 when in closed position as shown in FIGS. 1–3 and 8. The back of lower edge 3 is connected by means of a hinge 13 with the upper edge of back wall 14 so that upper lid 2 can be swung open, as in the manner of FIG. 9. Conventional left and right snaps 4 and 8 are at the front of the medical box. Reference numeral 9 designates the place at the front center of the medical box for a cassette recorder 47 which comprises a door 5, and a window 6, and which contains a reel of tape 10. The upper part of cassette recorder 47 contains control buttons 7. The back of the medical box contains two small upper bases 11 and two small lower bases 12** for steady support of the medical box, if laid on its back.

Figure 4:
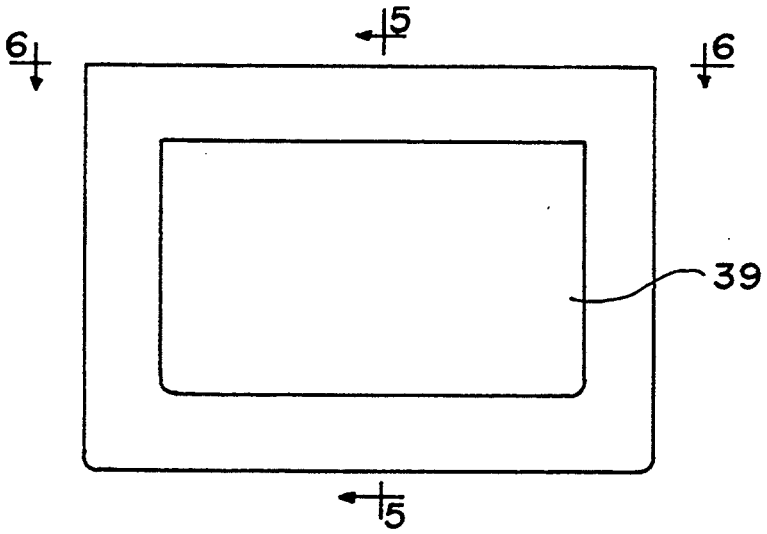
FIG. 4 is a right side elevational view of the medical box with the lids having been removed for illustrative purposes.
Figure 5:
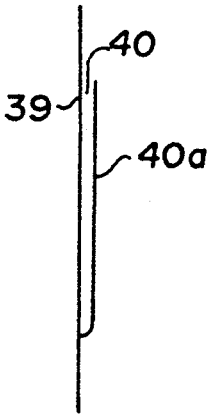
FIG. 5 is a vertical cross-sectional view in the direction of arrows 5—5 in FIG. 4.
Figure 6:
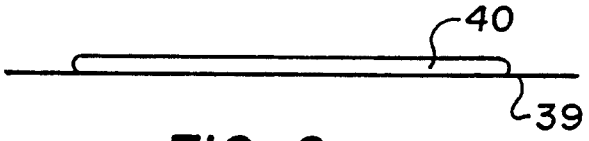
FIG. 6 is a top view taken in the direction of arrows 6—6 in FIG. 4.
Figure 7:
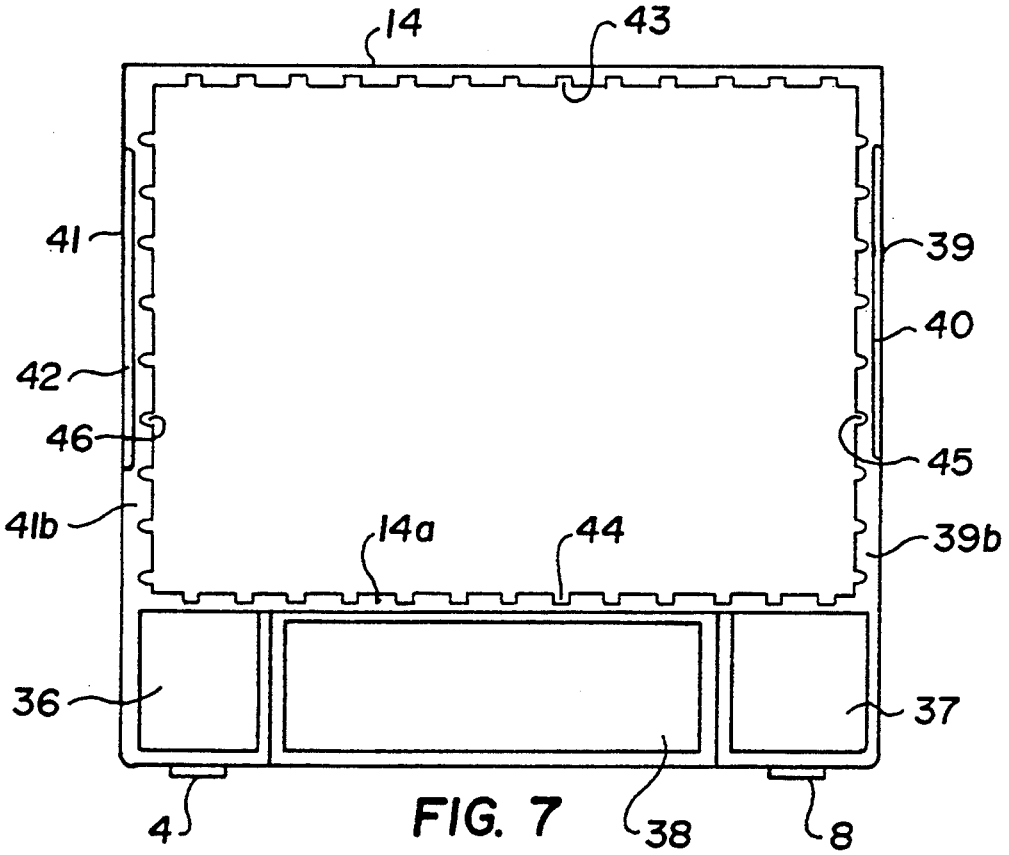
FIG. 7 is a top plan view of the main body of the medical box by itself.

FIG. 7 shows that each side wall 39*b*, 41*b* contains a corresponding clear plastic window 39, 41 designed for placement of printed materials, pictures, etc. FIGS. 4–6 show further detail relevant to window 39. A plastic back wall 40*a* cooperates with window 39 to provide a space 40 into which printed materials can be inserted. FIG. 7 also shows a space 38 for cassette recorder 47 and two spaces 36, 37 to either side of space 38 for insertion of special medication, such as eye drops or nitroglycerin tablets. The reference numeral 42 designates a space behind window 41.

The main space of body 1 is between back wall 14 and a wall 14*a* that is behind space 38. Vertical depressions, or slots, 43, 44, 45, 46 respectively are in walls 14, 14*a*, 39*b*, 41*b* respectively.

Figure 8:
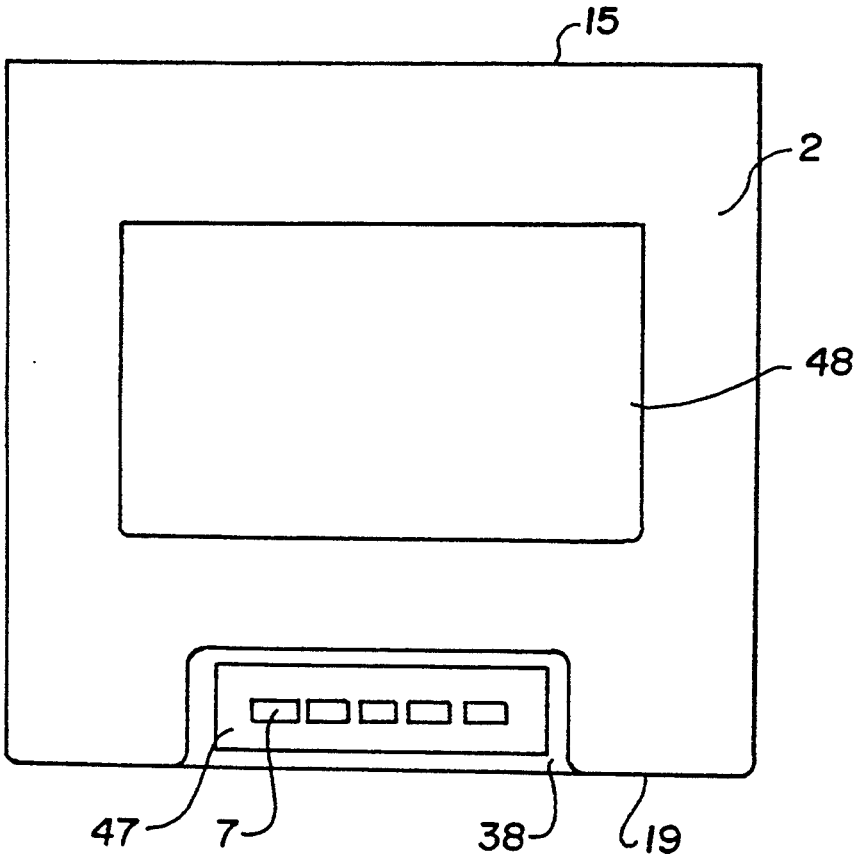
FIG. 8 is a top plan view of the medical box with the lids closed.

FIG. 8 shows a clear window 48 in the center of upper lid 2. When upper lid 2 is opened about 90 degrees as in FIG. 9, two plastic walls A and B can also be swung open. The reference numeral 16 refers to the upper wall of upper lid 2; and the reference numeral 28, to the lower edge of upper lid 2.

Figure 9:
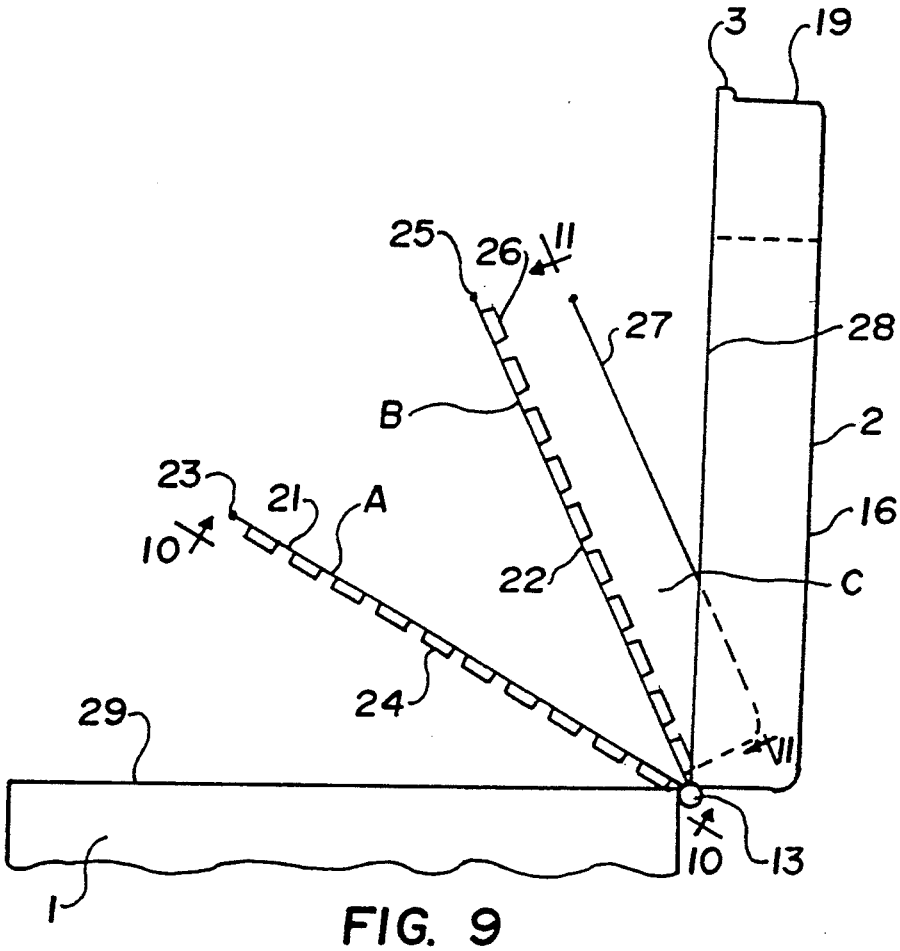
FIG. 9 is a fragmentary right side elevational view with the lids open.
Figure 10:
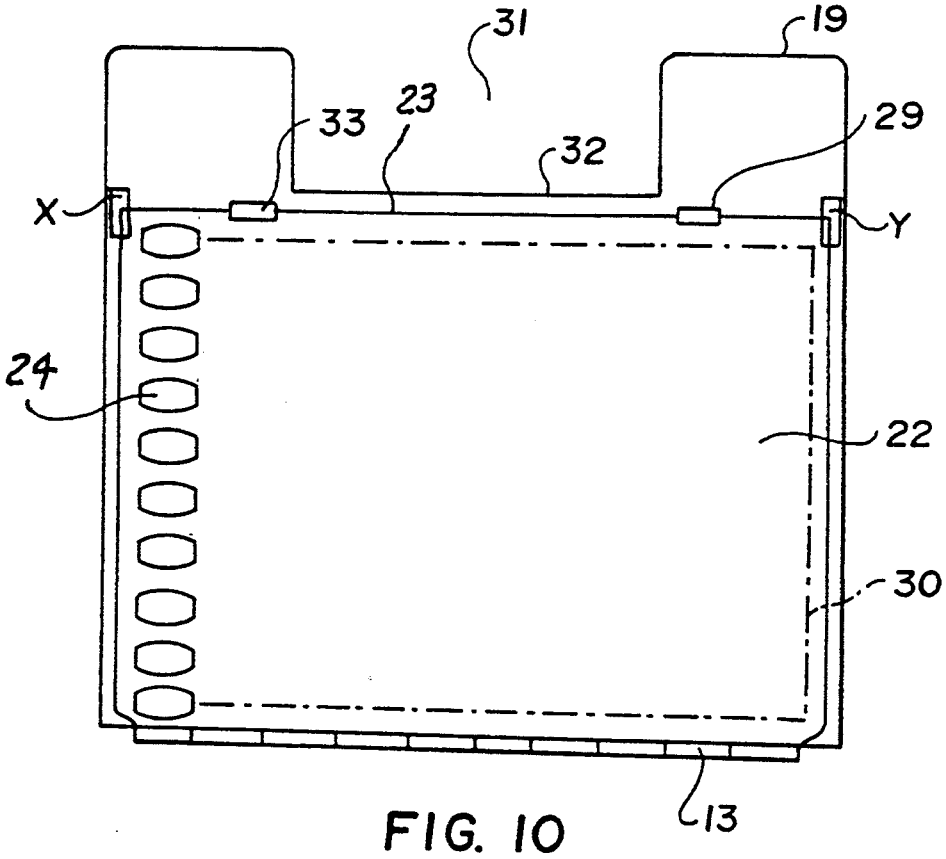
FIG. 10 is a view in the general direction of arrows 10—10 in FIG. 9, but with the lids together.

As seen with reference to FIGS. 9 and 10, plastic wall A comprises a body 21 having a front edge 23 and places 24 for pill insertion. Likewise, plastic wall B comprises a body 22, having a front edge 25, and places 26 for pill insertion. FIG. 10 shows front edges 23 and 25 held tight to each other by the use of snaps 33, 29. A clear plastic piece 27 attaches to plastic wall B close to the latter's connection to hinge 13. Piece 27 cooperates with plastic wall B to create a space C that can hold certain flat medications such as skin patches, as well as holding notes, cards, and my Medical Passport.

FIG. 10 shows the view when the box is open and the plastic walls A and B are in their place inside upper lid 2. Snaps X and Y, which are connected to upper lid 2, hold plastic walls A and B in place. The locations of pill places 24, 26 are along the left side, and a space 22 for my Medical Chart is to the right of the pill places. Snaps 29, 33 that hold plastic walls A and B together tight are shown along edges 23, 25. A broken line 30 shows the outline of the very narrow space 22 between the two plastic walls A and B which is designed to hold my Medical Chart inside it. My Medical Chart is a piece of thick paper or plastic that has color bands along side the pill spaces and directions for the pills written on them. Upper lid 2 has a cut-out space 31 providing clearance for cassette recorder 47 when the upper lid is closed. The front facing edge 32 of space 31 is in the middle of upper lid 2.

Figure 11:
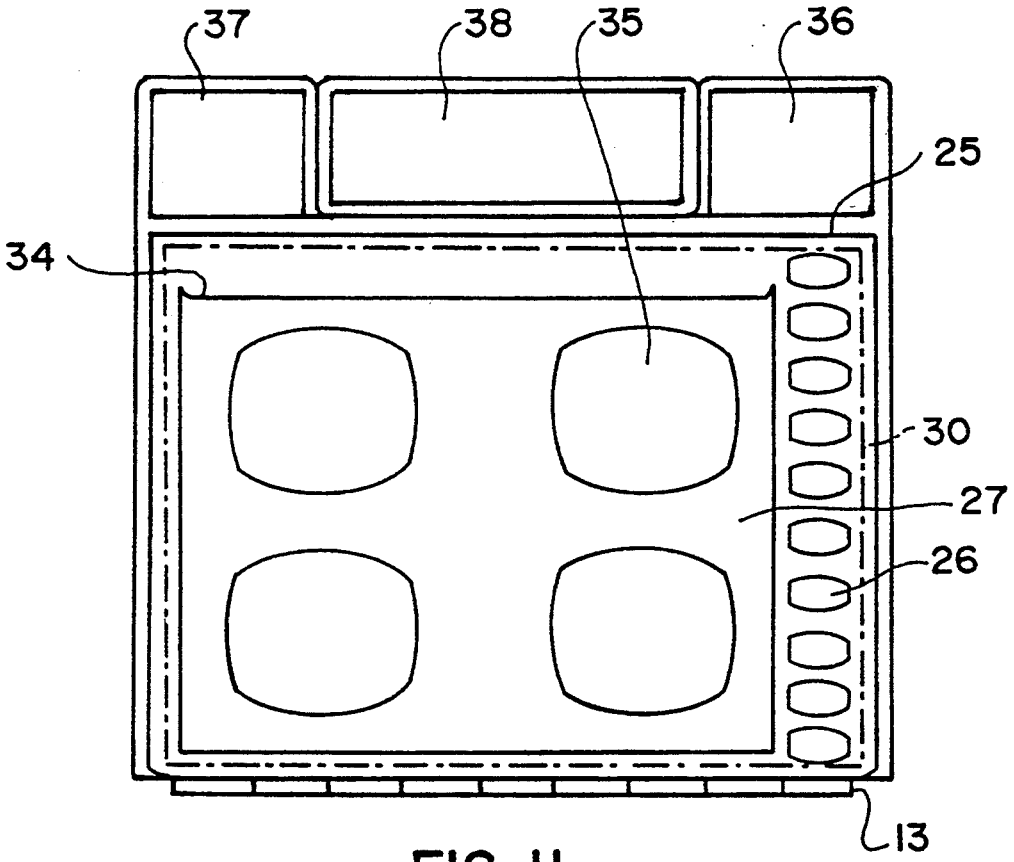
FIG. 11 is a view looking in the direction of arrows 11—11 in FIG. 9.

FIG. 11 is a view looking toward the upper surface of plastic wall 27 when closed onto body 1 of the box. With snaps 29 and 33 holding walls A and B together along front edges 25 and 23, and with walls A and B being hinged via hinge 13 along opposite edges, it should be appreciated that the snapped-together walls A and B form an inner lid that can be swung open and closed on body 1, as suggested by FIG. 9. As should also be appreciated, this inner lid will fit into, and swing open and closed in unison with outer lid 2 when the two lids are held together by means of snaps X and Y. When snaps 29, 33 are unsnapped, walls A and B can open, as in FIG. 9, to allow access to spaces 24, 26, 22. When walls A and B are closed together, spaces 24, 26 create a home for pills that have been placed therein and space 22 creates a home for my Medical Chart that has been placed therein. Medical Chart has colored lines, bands, and directions correlated with the pills. Piece 27 is clear plastic and contains a hole 35 that allows one's fingers to go inside to help remove the things from space C. The numeral 34 shows the front edge of piece 27 and the opening of space C is next to it.

Figure 12:
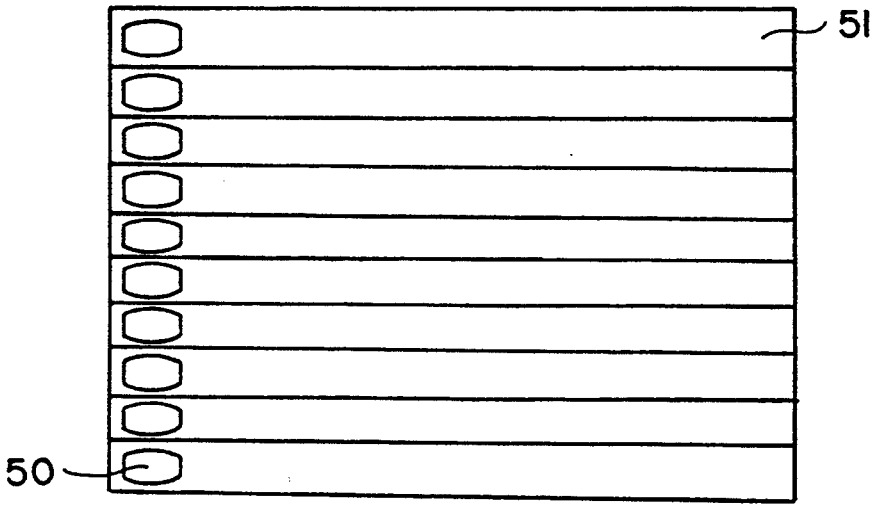
FIG. 12 is a top plan view of a medical chart by itself, the medical chart being used in association with the inner lid.

FIG. 12 shows the general arrangement of my Medical Chart which is made from a relatively thick and heavy paper or plastic that has perforated areas 50 which will stay between pill spaces 24 and 26 to allow them to be connected to each other. Along side each perforated area 50 there is a colored band area, such as one shown by 51. Each can be colored one color, such as red, blue, yellow, pink, etc., or combinations thereof. In the center of each colored band there is space to have the name and purpose and directions of the medication to be written and specified such as "Lanoxin—Heart Pill, one tablet a day." This chart will stay in place between walls A and B as shown by broken line 30. It can be taped with a small piece of adhesive tape to prevent it from moving.

Figure 13:
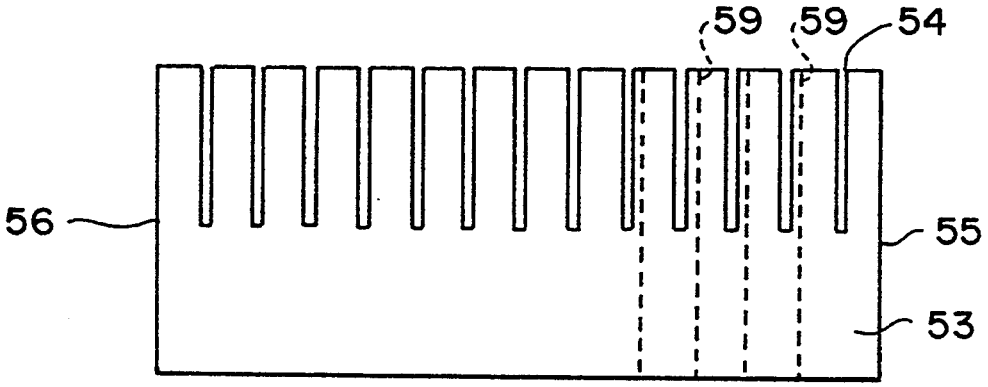
FIG. 13 is an elevational view of an internal dividing wall that is used in the main body of the medical box.

FIG. 13 shows a long dividing wall which fits between slots 46 and 45 in FIG. 7. Naturally, to divide the box into many small places many of these dividing walls are needed, and are provided. Numeral 53 shows the solid part of the dividing wall, and numeral 54 shows cuts that allow other smaller dividing walls (shown in FIG. 14) to sit inside it. The broken line 59 shows thin lines that allow the wall to be cut shorter in order to allow the spaces between the walls to be larger.

Figure 14:
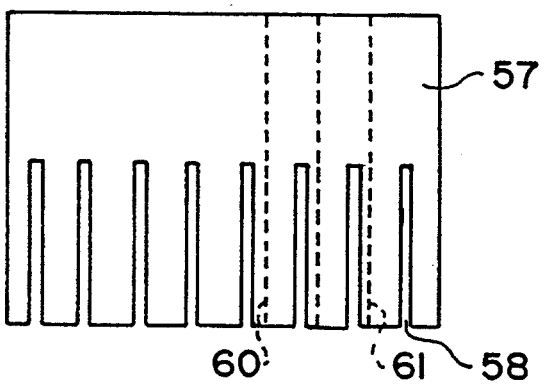
FIG. 14 is an elevational view of another internal dividing wall that is used in the main body of the medical box.
Figure 15:
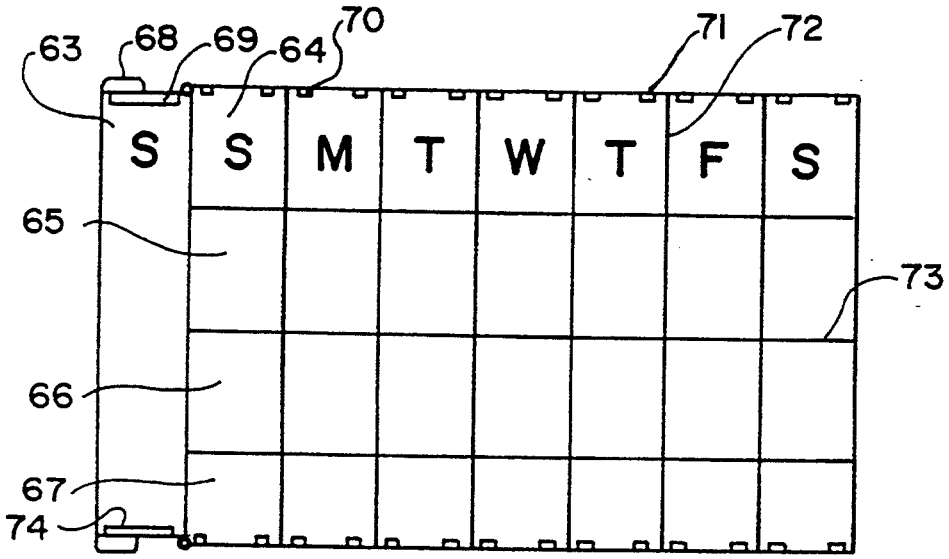
FIG. 15 is a top plan view of a weekly pill container box that fits inside the medical box, the doors having been removed for illustrative purposes.

FIG. 14 shows a short dividing wall which fits between slots 43 and 44 (FIG. 7) from front to back. Again, to divide the box into many small places there will be many of these short dividing walls. Numeral 57 shows the solid part, and numeral 58 shows cuts that allow the larger walls (shown in FIG. 13) to sit inside it. The broken line number 60 shows thin lines that allow the wall to be cut shorter in order to allow the spaces between the walls to be larger.

FIGS. 15–22 show the weekly pill container 90. It comprises twenty-eight boxes arranged as four rows of seven columns. The short walls 72 divide the container into the seven columns, and the long walls 73, into the four rows. The upper row as viewed in FIG. 15 has initials of the days of the week, S for Sunday, M for Monday, etc. The upper row is for medications to be taken in the mornings, the next row for medications to be taken at noon, the next row for medications to be taken afternoons or evenings, and the final row for medications to be taken evenings. The boxes of the final row are smaller than the others because less medications are usually taken in the evenings.

Doors are associated with the columns as follows. A door S for the Sunday column, a door SM for the Sunday-Monday column, a door MT for the Monday-Tuesday column, a door TW for the Tuesday-Wednesday column, a door WT for the Wednesday-Thursday column, a door TF for the Thursday-Friday column, and a door FS for the Friday-Saturday column.

Figure 16:
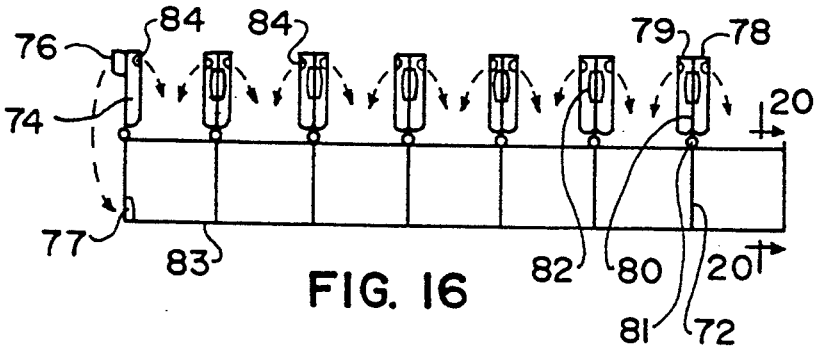
FIG. 16 is a front elevational view of the weekly pill container box showing the doors in open positions.
Figure 17:
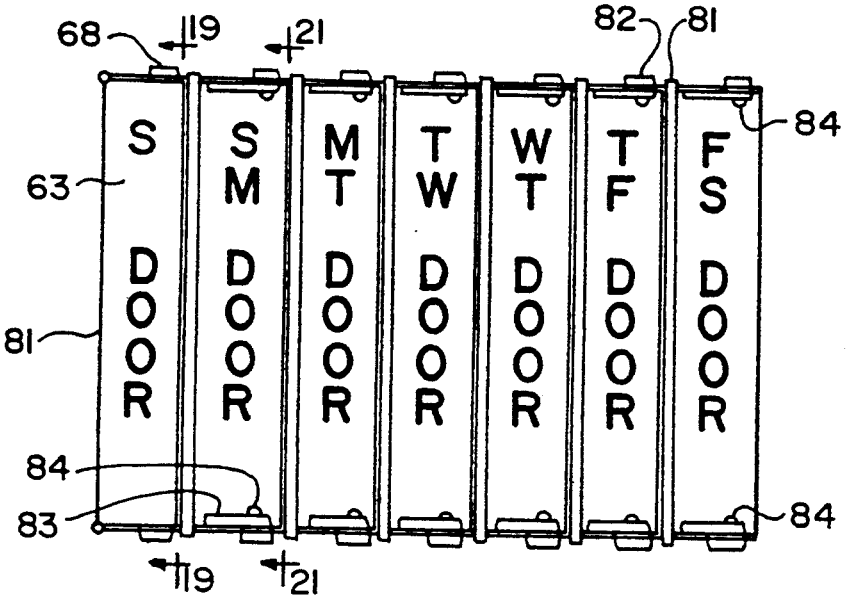
FIG. 17 is a top plan view of the weekly pill container box with the doors in closed positions.

Each door is attached to container 90 by a respective hinge 81 along its left-hand edge as viewed in FIG. 17, which shows each door S, SM, MT, TW, WT, TF, FS closed on a corresponding column. FIG. 16 shows that the doors can be opened by swinging them counterclockwise as viewed in that FIG. Each door 68 has a little handle 82 that helps the door to be pulled from its closed position. Each such handle projects from the body 80 of the door along an edge of the body that extends perpendicularly from the edge connected to hinge 81.

Each door also has wall structure for engaging the container to assist in holding the door in a particular position. This wall structure is identical for all doors except door S. This wall structure of door S comprises plastic walls 69, 74 that fit inside the Sunday column when door S is closed. The walls 69, 74 contain indentations 84 for engagement with indentations 71 on the container for holding walls 69, 74 in place on the container so as to prevent the free opening of door S when closed on the Sunday column. On the face of door S opposite the face that contains walls 69 and 74 is a tiny plastic wall 76 that goes over an indentation 77 in the lower corner of the container to hold door S against the outside of the container when the door is swung 270 degrees counterclockwise from the closed position, as will be explained more fully later on.

The wall structure for assisting in holding the six other hinged doors on the container in particular positions comprises walls 78 on one face and walls 79 on the opposite face. These tiny plastic walls 78, 79 are for fitting into the columns of the container on each side of the corresponding hinge, as will be explained more fully later on. They also have indentations 84 for engagement with indentations 70, 71 in the wall of the container columns.

The twenty-eight boxes are filled with medications for the week and each door is closed on a corresponding column, door S closing the first S column, the door SM closing the M column, the MT door closing the first T column, the TW door closing the W column, the WT door closing the second T column, the TF door closing the F column, and the FS door closing the second S column. On Sunday morning, the patient opens door S to expose the four Sunday boxes 64, 65, 66, and 67 containing the Sunday medications for the four different times of day mentioned. Door S can be fully swung open and stuck against the outside of the left side of the container, leaving all Sunday medications uncovered.

Figure 18:
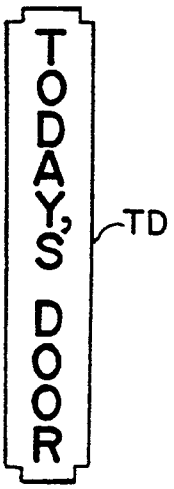
FIG. 18 is a top plan view of an extra door by itself that is used with the weekly pill container box.
Figure 19:
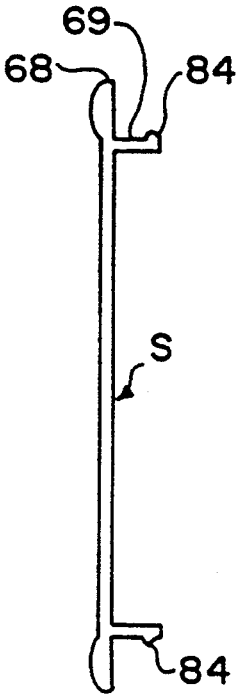
FIG. 19 is a view of one of the doors by itself as taken along line 19—19 in FIG. 17.
Figure 20:
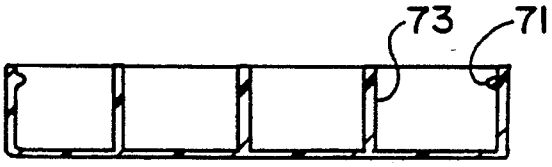
FIG. 20 is a cross-sectional view as taken along line 20—20 in FIG. 16.
Figure 21:
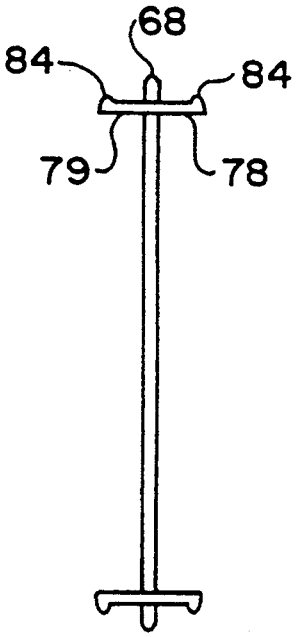
FIG. 21 is a view of another of the doors by itself as taken along line 21—21 in FIG. 17.
Figure 22:
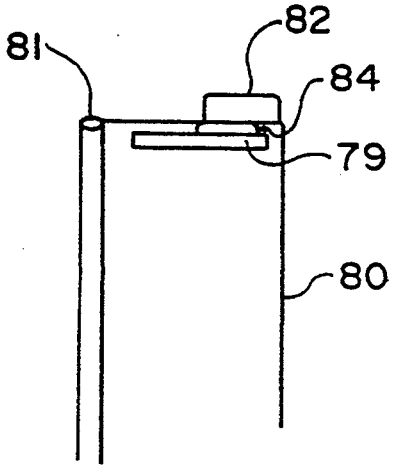
FIG. 22 is an enlarged fragmentary view showing additional detail relevant to the door of FIG. 21.

A special door TD, called Today's Door, is provided as a separate universal part that can be used to close any open column of the container. FIG. 18 shows door TD by itself.

Weekly pill container 90 is intended to open only one day's medications at a time. Thus, when the patient opens door S, only the Sunday medications are exposed. If desired, such as when the container is being transported, the special door TD is used to close the open Sunday column.

On Monday morning, the Sunday medications have been taken so that boxes 64, 65, 66, and 67 are empty. Assuming that special door TD is not being used, and that door S has been fully opened and stuck against the outside of the container, the first S column is open. The door SM is also closing column M at this time. Now, if door SM is swung 180 degrees counterclockwise as viewed in FIG. 16, it will be closed on the Sunday column and will open the Monday column to expose the Monday medications.

This procedure may be repeated with successive doors on successive days until the Saturday medications have been taken. In this way only the medications for a particular day are exposed at any time, subject to the possibility of closing the open column by using door TD, as desired. Thus, the weekly pill container allows only one day's medications to be open at a time, unless the patient ignores directions. The weekly pill container allows the patient easy access to medications for one day and helps to prevent confusion. If the patient has to go somewhere and/or wants to close that day's medications, the special door TD is fitted to the open column for that day.

It is intended that each door contains a title for the particular day's medications that it is covering. Thus, the face of the Sunday door that is seen when it is covering the Sunday column contains the writing "Sunday Medications". The other doors are correspondingly identified in similar fashion. The special door is marked with the writing "Today's Door" and in this regard will have a special color. The back face of each door may have a special color or mark so that when it is seen closing a column whose medications have already been taken, it will provide a signal of that to the patient so that the patient will not open it.

The weekly pill container is made from a flat plastic box of 22 by 13 by 2.2 cm. This will allow it to fit inside the medical box in the manner of FIG. 23, sitting on two small horizontal plastic walls 91, 92 attached to the inside of the medical box. In this way, the weekly pill container can occupy a space above medicine bottles 94 in the bottom of the medical box and below the inner lid formed by walls A and B. Slight construction adjustments can be done easily to allow the weekly pill container to be placed inside the medicine box, such as making space C smaller. The corners of the small boxes for the pills will be curved to allow the pills to be removed easily and the space to be cleaned easily. When each hinge-connected door is closing the column on the right of its hinge as viewed in FIG. 16, the walls 69, 74, 78 with their indentations 84 are engaging with the indentations 71 of the columns to hold the doors closed. When the doors are swung counterclockwise, the six doors on the right cover the six columns that are to the left of their hinges as viewed in FIG. 16 with their walls 79 and indentations 84 on walls 79 engaging with indentations 70 to keep the doors closed. The left-most door SD uses walls 76 to engage indentations 77 to hold it open against the outside of the container.

Figure 23:
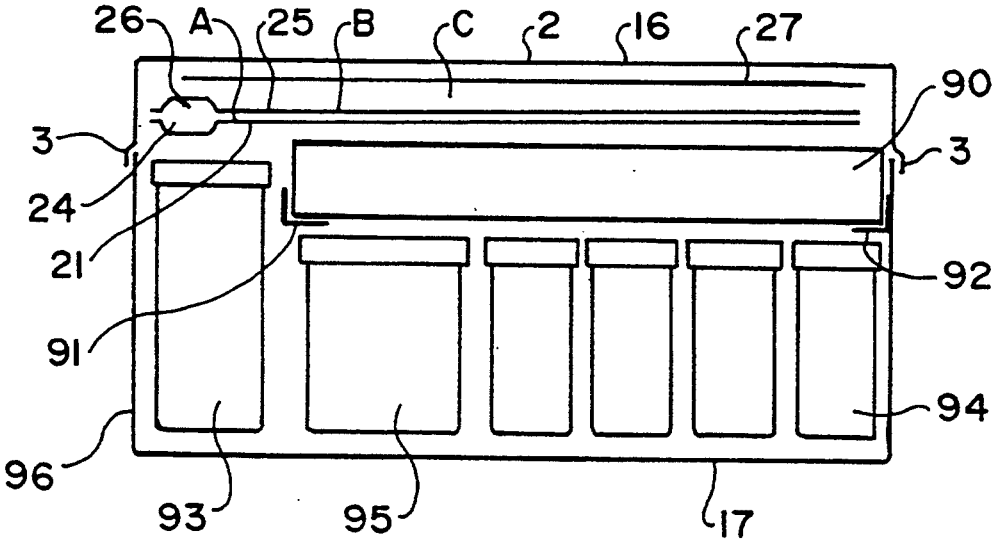
FIG. 23 is a vertical cross-sectional view through the medical box from the front to show the organization and arrangement of various parts when the medical box is used and the lids are closed.

FIG. 23 shows the arrangement of the contents of the medical box when both the upper lid 2 and the inner lid (walls A and B) are closed. The weekly pill container 90 is supported in overlying relationship to shorter pill bottles 94, 95, the latter pill bottle being wider than the former bottles. The weekly pill container is not in overlying relation to a taller pill bottle 93. The medical box is made of plastic materials, and the inside of the bottom contains a soft layer of sponge to allow the medication bottles to sit easily on it. The main body of the medical box is divided by long and short dividing walls (FIGS. 13 and 14) into small spaces. These dividing walls are about 1.5 to 2 mm thick and their ends fit into vertical depressions, or slots, in the walls of the body of the box, as explained earlier. There are many such slots to allow the spaces to be adjusted easily when necessary. The upper lid 2 has a clear plastic window for insertion of papers. Inside the upper lid is the inner lid consisting of walls A and B together. As mentioned earlier, this inner lid is to hold pills and my Medical Chart. New directions can be written on paper which has adhesive on its back for gluing over old ones when needed. The inner lid also provides the space C for my Medical Passport, or other notes, directions, information health or appointments, or medications such as patches, etc. In the front of the medical box is the space for the cassette recorder to be inserted. The cassette recorder can be permanently fixed or removable. The cassette recorder will operate with a battery and will have space for an electric charger to be used too. The cassette recorder will allow a patient to record medical advice and orders given to him or her by medical staff at the time of the doctor's office visit, and the patient can also have the orders about medications, directions, etc., to be nicely recorded by the familiar voice of his or her own family members. The patient can then listen whenever and as many times as he or she may want about recommendations for the medications.

The medical box may have a handle (not shown) in the top to be held. It may have space to hold cassette tapes. The spaces in the front corners next to the cassette recorder may be used for emergency medications such as Nitroglycerine tablets where it could be accessed conveniently. The buttons of the cassette recorder may be conveniently colored for patient use, and directions may be printed on its front.

The upper lid and the sides of the main body of the box have windows for insertion of a thick piece of paper that can contain directions or a picture of a person or another thing such as a nice painting, etc.

In order to make the daily use of medications easy for the patient and to eliminate the need for the patient to open the box each time for taking a medicine out of a bottle, the weekly pill container 90 is designed to hold the medications of one week in separate boxes. There is a column of four boxes for holding each day's medications.

This invention is based on a very useful device that I believe that I am the first to design: a box that has clear windows in its sides and its top for insertion of photos or written materials, directions, etc., to give ease of reading and visualizing them without need for opening the box, and it may also have a record player fixed to its wall to allow tapes to be conveniently listened to. It also has a space for insertion of other materials such as books, cassette tapes, food, tools, etc. This box has many uses, for example a lunch box that has clear windows for a child's own picture, name, and classroom, as well as other pictures he or she may wish to insert. In such case, there may be no need for a cassette recorder. Although a cassette recorder may be used very effectively in case the parent wants the child to do something, and he or she did not have time to explain. The cassette recorder can be used for both recording as well as listening. It has a place for the use of earphones in conditions where noise is a problem. The box has many uses, for example a person can have educational tapes inside the box as well as related booklets in its top lid and with a chart which tells which tapes have what material, all in one piece. This will allow a person to choose and listen to the tapes, any place he or she wishes to use. Another use can be imagined when papers and directions for someone are to be left for another to come and use when shifts change. This kind of briefcase will allow the person to leave them inside it and to dictate all the directions and the second person to come and listen to the tape and pick up the related papers and materials much more conveniently. Therefore, briefcases can be made with use of this technique to allow this convenient invention to be used. A lunch box with cassette tape recorder can be used very nicely by the parents that want their child to hear their voice and message later, for one reason or another.

Various forms of sheet material, such as those already mentioned, can be inserted into the spaces behind the windows. The windows in the box are shown rectangular in shape and made of clear plastic. There are very narrow walls in three sides to connect to the box leaving one side open for insertion of the sheet material into the narrow space thus defined. A closure may be used to close the open side after the sheet material has been inserted into the space. Such a closure may be a zipper or plastic which has a cross cut like a wedge so that the thinner edge of the wedge can be inserted into the open side, and even glued in order to seal the open side when there is a need to permanently close it after insertion of the sheet material.

When the box is used as medical box, the pill bottles stored in the bottom of the box have unique colors. The color of each bottle is also displayed in the band extending from the corresponding pill in the pill space in the inner lid of the box.

What is claimed is:

1. A medicine box for use in dispensing pills comprising a main body means for defining an internal volume and lid means for rendering said internal volume selectively accessible and inaccessible by permitting opening and closing of said main body means, said main body means containing a pill bottle storage space within said internal volume, said medicine box further including a pill container for receiving a weekly supply of pills taken on a daily basis, said pill container removably supported on said main body means within said internal volume such that said pill container is located above said pill bottle storage space said lid means permitting access to said pill container, said main body means further comprising ledge means for supporting said pill container, said lid means comprising an outer lid and an inner lid, said inner lid including a plurality of compartments for receiving pills and sheets of printed material that convey information relevant to medication, said inner lid further including two transparent plastic walls secured together to cooperatively define said plurality of compartments.

2. A medicine box as set forth in claim 1, further including hinge means for cooperatively securing said two transparent plastic walls to one another and to said main body means, said plurality of compartments including pill-receiving spaces arranged in a row perpendicular to a hinge axis of said hinge means, said inner lid including a sheet of printed material having indicia arranged in bands extending parallel to said hinge axis.

3. A medicine box as set forth in claim 2, wherein said outer lid is hingedly mounted on said main body means, and means for separably securing said inner lid to said outer lid such that when said inner lid is secured to said outer lid, said two lids move in unison about said hinge axis, and when said inner lid is unsecured to said outer lid, said inner and outer lids move relative to each other about said hinge axis.

4. A medicine box as set forth in claim 1, further including a plurality of pill bottles disposed in said pill storage space, each pill bottle containing a supply of pills adapted to be placed in a corresponding compartment formed by said inner lid, each pill bottle and a corresponding compartment of said inner lid including matching indicia for aiding in the placement of specific pills in association with a corresponding compartment.

5. A medicine box as set forth in claim 1, further including a transparent window in said outer Lid for enabling a person to see into said internal volume.

6. A medicine box as set forth in claim 1, further including a third transparent plastic wall mounted on one of said first two transparent plastic walls and disposed to a side of said one of said first two transparent plastic walls that is opposite a side of said one of said first two transparent plastic walls that is toward the other of said first two transparent plastic walls, said one of said first two transparent plastic walls and said third transparent plastic wall forming a storage space between themselves.

7. A medicine box as set forth in claim 6, wherein said third transparent plastic wall comprises access holes through which a person's fingers may be inserted to obtain access to said storage space.

8. A medicine box for use in dispensing pills, comprising a main body means for defining an internal volume and lid means for rendering said internal volume selectively accessible and inaccessible by permitting opening and closing of said main body means, said main body means containing a pill bottle storage space within said internal volume, said medicine box further including a pill container for receiving a weekly supply of pills taken on a daily basis, said pill container removably supported on said main body means within said internal volume such that said pill container is located above said pill bottle storage space said lid means permitting access to said pill container, said main body means further comprising ledge means for supporting said pill container, said lid means comprising an outer lid and an inner lid, said inner lid including a plurality of compartments for receiving pills and sheets of printed material that convey information relevant to medication, wherein said main body means comprises a front wall, rear wall, and a pair of sidewalls, an interior wall is disposed within said internal volume parallel to said front wall such that said pill bottle storage space is formed by said rear wall and said interior wall, said interior wall and said front wall forming an internal forward volume with corner compartments between said sidewalls for storing emergency medicines, said internal forward volume being unobstructed by said pill container.

9. A medicine box as set forth in claim 8, wherein said medicine box comprises a further compartment lying between said corner compartments in said main body means, said further compartment being accessible both when said lid means is closing said main body means and when said lid means is opening said main body means, and a cassette recorder is disposed in said further compartment.

10. A medicine box for use in dispensing pills, comprising a main body means for defining an internal volume and lid means for rendering said internal volume selectively accessible and inaccessible by permitting opening and closing of said main body means, said main body means containing a pill bottle storage space within said internal volume, said medicine box further including a pill container for receiving a weekly supply of pills taken on a daily basis, said pill container removably supported on said main body means within said internal volume such that said pill container is located above said pill bottle storage space said lid means permitting access to said pill container, said main body means further comprising ledge means for supporting said pill container, said lid means comprising an outer lid and an inner lid, said inner lid including a plurality of compartments for receiving pills and sheets of printed material that convey information relevant to medication, wherein said outer lid contains a transparent window for permitting viewing of said internal volume when said lid means is in the closed position.

11. A medicine box for use in dispensing pills comprising a main body means for defining an internal volume and lid means for rendering said internal volume selectively accessible and inaccessible by permitting opening and closing of said main body means, said main body means containing a pill bottle storage space within said internal volume, said medicine box further including a pill container for receiving a weekly supply of pills taken on a daily basis, said pill container removably supported on said main body means within said internal volume such that said pill container is located above said pill bottle storage space said lid means permitting access to said pill container, said lid means comprising an outer lid and an inner lid, said inner lid including a plurality of compartments for receiving pills and sheets of printed material that convey information relevant to medication, said inner lid further including two transparent plastic walls secured together to cooperatively define said plurality of compartments.

12. A medicine box for use in dispensing pills comprising a main body means for defining an internal volume and lid means for rendering said internal volume selectively accessible and inaccessible by permitting opening and closing of said main body means, said main body means containing a pill bottle storage space within said internal volume, said medicine box further including a pill container for receiving a weekly supply of pills taken on a daily basis, said pill container removably supported on said main body means within said internal volume such that said pill container is located above said pill bottle storage space, said lid means permitting access to said pill container, said lid means comprising an outer lid and inner lid, said inner lid including a plurality of compartments for receiving pills and sheets of printed material that convey information relevant to medication, and further including a plurality of pill bottles disposed in said pill storage space, each pill bottle containing a supply of pills adapted to be placed in a corresponding compartment formed by said inner lid, each pill bottle and a corresponding compartment of said inner lid including matching indicia for aiding in the placement of specific pills in association with a corresponding compartment.

* * * * *